US005192041A

United States Patent [19]

Bryant

[11] Patent Number: 5,192,041

[45] Date of Patent: Mar. 9, 1993

[54] BABY BOTTLE HOLDER

[76] Inventor: Sheree M. Bryant, 1804 E. Oliver St., Baltimore, Md. 21213

[21] Appl. No.: 716,562

[22] Filed: Jun. 17, 1991

[51] Int. Cl.[5] ..... A47D 15/00

[52] U.S. Cl. ..... 248/104; 248/106

[58] Field of Search ..... 248/102, 160, 104, 105, 248/106, 107

[56] References Cited

U.S. PATENT DOCUMENTS

| | | | |
|---|---|---|---|
| 773,252 | 10/1904 | Frank . | |
| 1,786,459 | 12/1930 | Simons | 248/104 |
| 2,110,037 | 3/1938 | DeRosa | 248/104 |
| 2,448,189 | 8/1948 | Mott . | |
| 2,826,386 | 3/1958 | Conrad . | |
| 3,161,392 | 12/1964 | Kopec et al. . | |
| 3,410,512 | 11/1968 | Del Vecchio et al. . | |
| 3,425,653 | 2/1969 | Rauch . | |
| 3,999,731 | 12/1976 | Filip | 248/107 |
| 4,114,847 | 9/1978 | Bogensberger . | |
| 4,320,883 | 3/1982 | Bass . | |
| 4,733,836 | 3/1988 | Barnes | 248/106 |
| 5,008,793 | 4/1991 | Copeland | 248/160 X |
| 5,016,845 | 5/1991 | Pellegrino | 248/104 |
| 5,063,933 | 11/1991 | Takahashi | 248/160 X |

FOREIGN PATENT DOCUMENTS

| | | | |
|---|---|---|---|
| 730558 | 3/1966 | Canada | 248/104 |
| 1278094 | 10/1961 | France . | |
| 348780 | 10/1960 | Switzerland . | |

*Primary Examiner*—Carl D. Friedman
*Assistant Examiner*—Derek J. Berger
*Attorney, Agent, or Firm*—David Newman & Associates

[57] ABSTRACT

A device for supporting an infant's feeding bottle including a bottle holder, a first flexible rod optionally, a second flexible rod, a clamp member and a stand member. The feeding bottle may be selected from a plurality of feeding bottles having a range of different diameters. The device may be used while feeding an infant in a seat placed on a surface. The bottle holder has a flexible member for wrapping around the feeding bottle. The flexible member has VELCRO material, a buckle or the like for securing the feeding bottle to the bottle holder. The first flexible rod is attached to the bottle holder and the stand member. The second flexible rod may be pivotally attached to the first flexible rod. The clamp member is attached to the second flexible rod for clamping to the seat.

3 Claims, 5 Drawing Sheets

Fig. 1
PRIOR ART
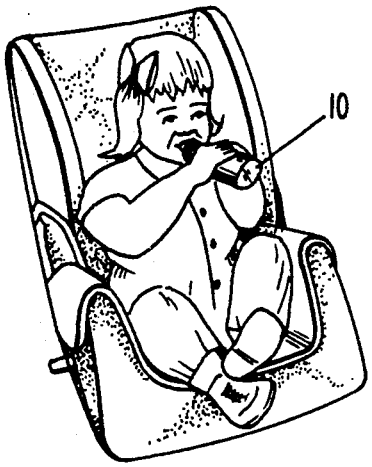
Fig. 2A
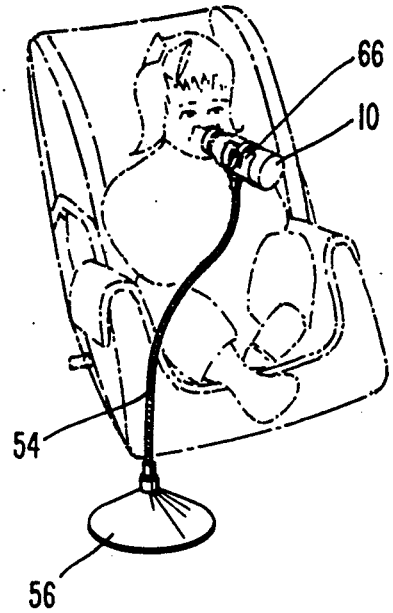
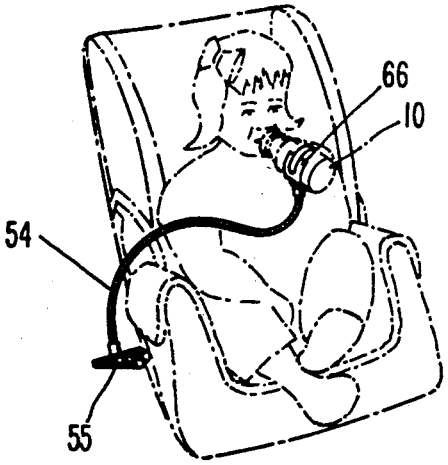
Fig. 2B
Fig. 2C
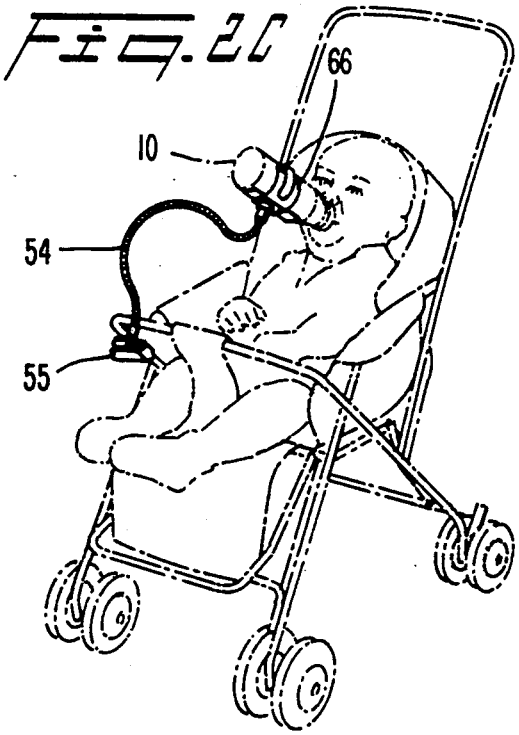

Fig. 4D
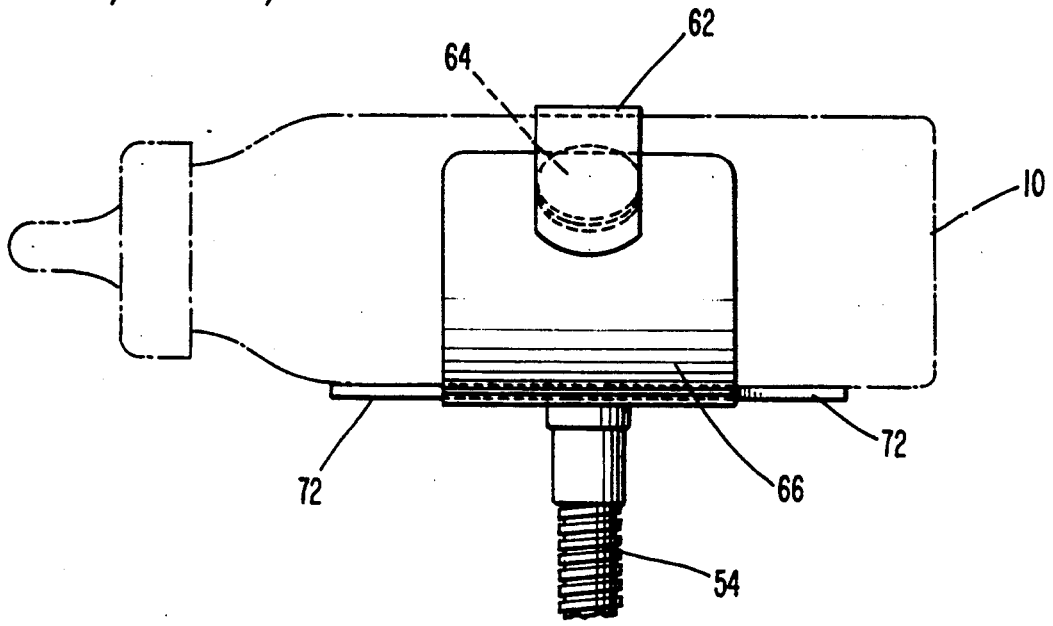
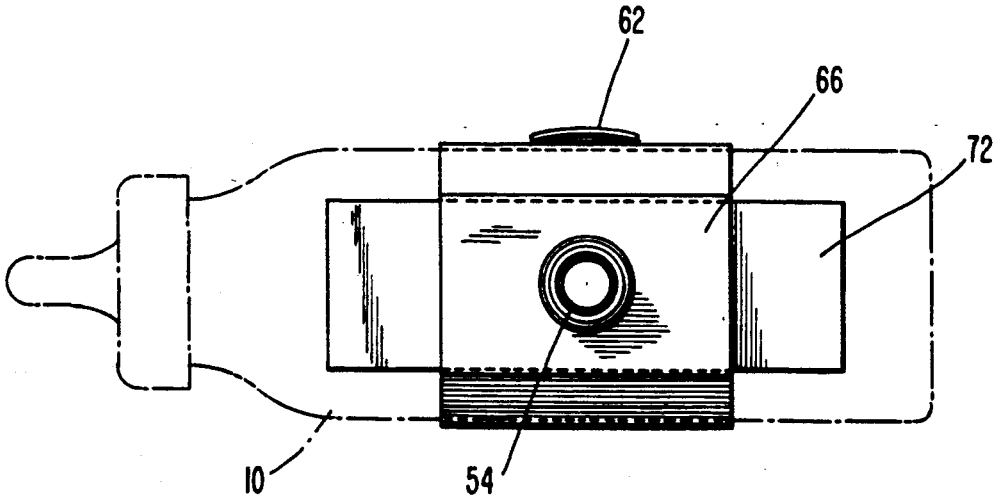
Fig. 4E

BABY BOTTLE HOLDER

BACKGROUND OF THE INVENTION

This invention relates to a baby bottle holder, and more particularly to a baby bottle holder which may be used in conjunction with a stroller or seat or the like.

DESCRIPTION OF THE PRIOR ART

The prior art includes a plurality of different types of baby bottle holders, all of which have various aspects. These existing devices include those disclosed in the following U.S. Pat. Nos.: 773,252; 2,448,189; 4,320,883, and Swiss Patent No. 348,780. These patents generally teach an adjustable clamping means or open spring means for grasping around a portion of the bottle for securing the bottle to the holding device. Also, these patents disclose a clamping means for attaching the bottle to a frame, brace, or post of a crib or other device.

A well known prior art method is shown in FIG. 1, with an infant holding a feeding bottle. No stand or support is used.

The prior art method and devices have not taught a baby bottle device for use with a stroller or seat which may be placed on a surface, having means for stabilizing the baby bottle and holder.

SUMMARY AND OBJECTS OF THE INVENTION

An object of the present invention is a device for supporting an infant's feeding bottle which may be attached to a stroller, seat, or the like.

Another object of the invention is a device which is relatively stable for holding a feeding bottle, with respect to an infant's movement.

According to the present invention, as embodied and broadly described herein, a baby-bottle support apparatus for supporting an infant's feeding bottle is provided comprising a bottle holder, a first flexible rod, a second flexible rod, a clamp member, and a stand member. The infant's feeding bottle may be selected from a plurality of feeding bottles having a range of different diameters. The bottle includes a ridged member for stabilizing the feeding bottle. The bottle holder also includes a flexible member attached to the ridged member for wrapping around the feeding bottle. The flexible member includes a buckle or the like for securing the feeding bottle to the ridged member of the bottle holder.

The first flexible rod has a first end attached to the bottle holder. A second end of the first flexible rod is attached to the stand member. The stand member is for stabilizing the first flexible rod, and therefor the entire device, on a surface. A second flexible rod has a first end which may be pivotally attached to the first flexible rod. A second end of the second flexible rod is attached to the clamp member. The clamp member is for clamping the second end of the second flexible member to the seat, stroller, or the like. The second flexible rod is optional and provides more stability than when only a first flexible rod is used.

After adjustment by an adult to an adjusted position, the combination of the first flexible rod and the second flexible rod, by the resilience of each of the first and second flexible rods, provides substantial resistance to movement of the bottle holder due to pivoting of the pivotal attachment and due to the infant.

Additional objects and advantages of the invention will be set forth in the description which follows, and in part will be obvious from the description, or may be learned by practice of the invention. The objects and the advantages of the invention also may be realized and obtained by mean of the instrumentalities and combinations particularly pointed out in the appended claims.

BRIEF DESCRIPTION OF THE DRAWINGS

The accompanying drawings, which are incorporated in and constitute a part of this specification, illustrate particular embodiments of the invention, and together with the description, serve to explain the principles of the invention.

FIG. 1 illustrates a prior art method of having an infant hold a bottle;

FIG. 2A illustrates the baby-bottle support apparatus with a first flexible rod connected to a stand member;

FIG. 2B illustrates the baby-bottle support apparatus with the first flexible rod attached to a seat on a surface;

FIG. 2C illustrates the baby-bottle support apparatus the first flexible rod with a clamp attached to a stroller;

FIG. 4D illustrates a side view of the bottle holder;

FIG. 4E illustrates a bottom view of the bottle holder;

DETAILED DESCRIPTION OF THE PREFERRED EMBODIMENTS

Figure 3A:
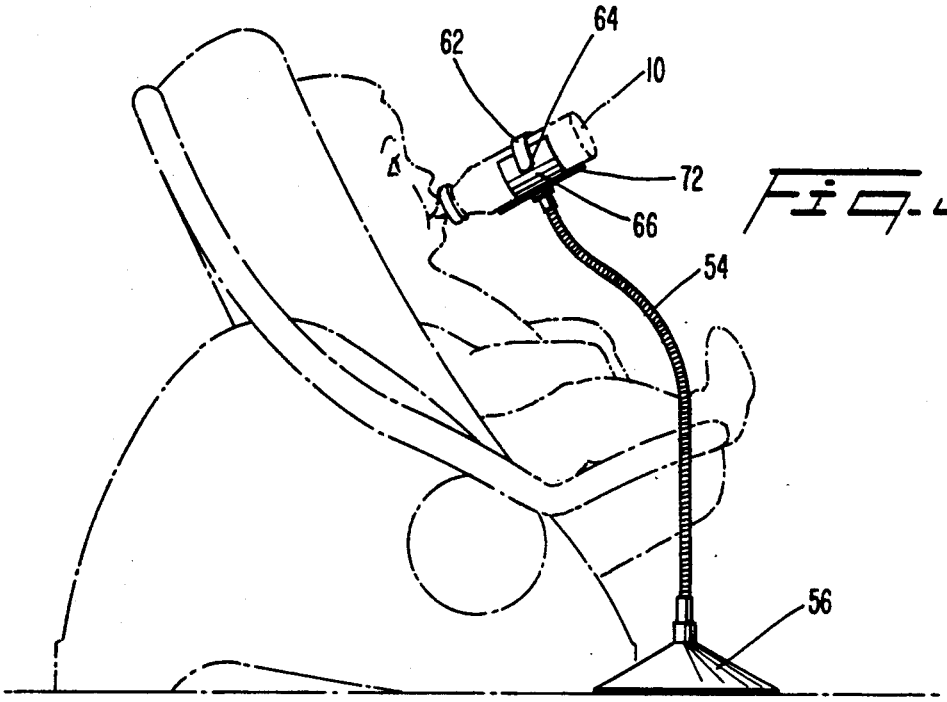
FIG. 3A illustrates the baby bottle support apparatus with a first flexible rod.

Reference will now be made in detailed to the present preferred embodiments of the invention, examples of which are illustrated in the accompanying drawings, wherein like reference numerals indicate like elements throughout the several views. Referring to FIGS. 2A, 2B, and 2C, a device for supporting an infant's feeding bottle is shown in various embodiments. In FIG. 2A, the device includes a bottle holder connected to a first flexible rod, which is further connected to a stand member for stabilizing the device on a surface. In FIG. 2B, the device for supporting an infant's feeding bottle is shown having a bottle holder connected to a first flexible rod, which is further connected to a clamp member for connecting to a seat. In FIG. 2C, the device for supporting an infant's feeding bottle is shown having a bottle holder, a first flexible rod and a clamp member for clamping to a stroller. All of these devices, which can be used for supporting an infant's feeding bottle, may support any feeding bottle selected from a plurality of feeding bottles having a range of different diameters. In all cases, in these embodiments the baby-bottle support avoids having the baby prop the baby's own bottle, as shown in FIG. 1.

Figure 3B:
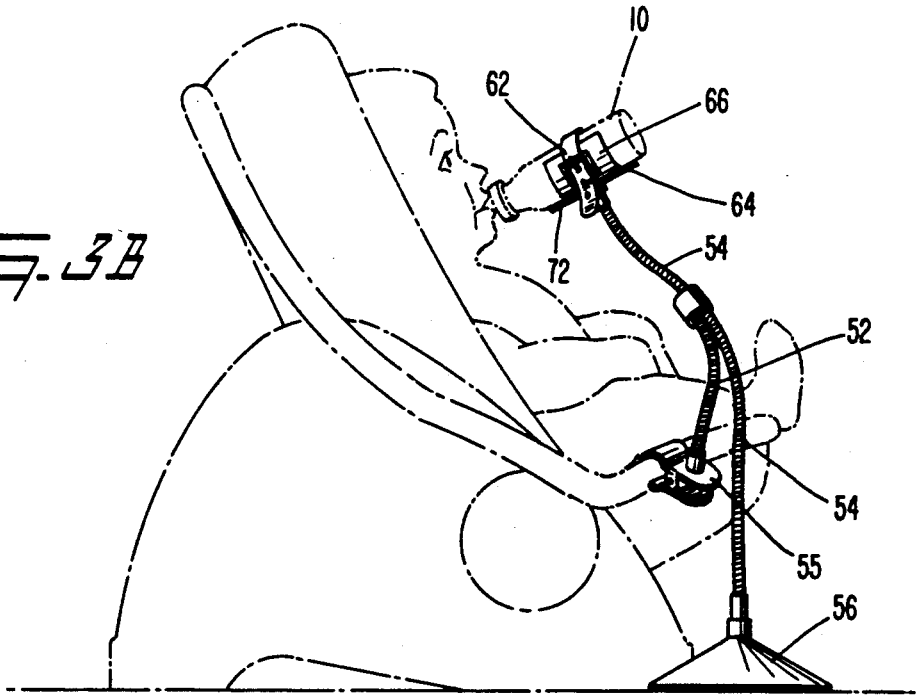
FIG. 3B illustrates the baby-bottle support apparatus with a first flexible rod and a second flexible rod.

In the exemplary arrangement shown in FIG. 3A, a baby-bottle support apparatus is provided for supporting an infant's feeding bottle. The feeding bottle may be selected from a plurality of feeding bottles having a different range of diameters. The baby-bottle support apparatus can be used for feeding an infant in a seat. The device includes a bottle holder, a first flexible rod 54, and a stand member 56. The bottle holder includes a flexible member 66, and means for securing the feeding bottle to the rigid member. The securing means may be embodied, as shown in FIG. 3A, using a VELCRO material 64 which includes hooks and loop fasteners. Alternatively, the securing means may use a buckle, buckle 64, as shown in FIG. 3B, or any other device as is well known in the art for accomplishing the securing function. The rigid member 72 stabilizes the feeding bottle in the bottle holder. The flexible member 66 wraps around the feeding bottle 10. The flexible member 66 includes means for securing the feeding bottle to the rigid member 72.

The first flexible rod 54 has a first end which attaches to the bottle holder. A second end of the first flexible rod attaches to a stand member 56. The stand member 56 supports and stabilizes the baby-bottle-support apparatus on a surface.

As illustratively shown in FIG. 3B, a baby-bottle support apparatus for supporting an infant's feeding bottle is provided, where the feeding bottle may be selected from a plurality of feeding bottles having a different range of diameters. The device can be used for feeding the infant in a seat and placing the device on a surface. The device comprises a bottle holder, a first flexible rod 54, a second flexible rod 52, a clamp member 58, and a stand member 56. The bottle holder includes a flexible member 66, and a buckle 64. The bottle holder optionally may include the rigid member 72. The ridged member 72, when used, is for stabilizing the feeding bottle 10 in the bottle holder. The flexible member 66 wraps around the feeding bottle 10, and attaches to the ridged member 72. The flexible member 66 includes a buckle 64 for securing the feeding bottle to the ridged member 72.

The first flexible rod 54 has a first end which attaches to the bottle holder. A second end of the first flexible rod 54 may attach to a stand member 56. The stand member 56 is for stabilizing the device on a surface.

The device may further include a second flexible rod 52 having a first end connected pivotally to the first flexible rod 55. A second end of the second flexible rod 52 may connect to a clamp 55. The clamp 58 is for clamping the device to a seat.

The first flexible rod 54 and the second flexible rod 52 may be made from any flexible material such as goose neck lamp material. After adjustment by an adult to an adjusted position, the combination of the first flexible rod and the second flexible rod, by the resilience of the structure of each of the first and second flexible rods, provides substantial resistance to movement of the bottle holder due to pivoting of the pivotal attachment and due to the infant.

Figure 4A:
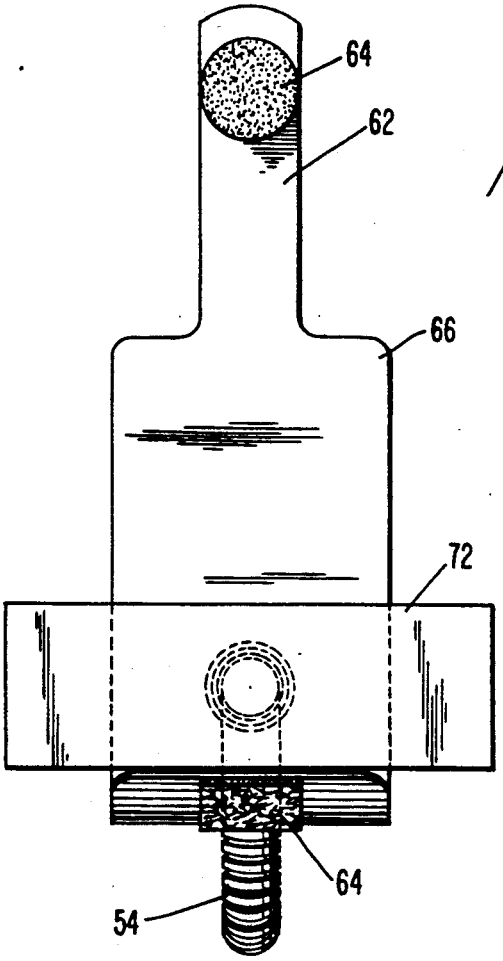
FIG. 4A illustrates the bottle holder.

FIGS. 4A, 4B, 4C, 4D, and 4E show an expanded view of the bottle holder of the present invention. As illustratively shown, FIG. 4A depicts the bottle holder connected to a first flexible rod 54, and having a ridged member 72 for stabilizing feeding bottles. A flexible member 66 is attached to the ridged member 72 for wrapping around a feeding bottle. Additionally, the flexible member 66 may include a small belt 62 having a buckle 64 or VELCRO material for securing the feeding bottle to the ridged member 72.

Figure 4B:
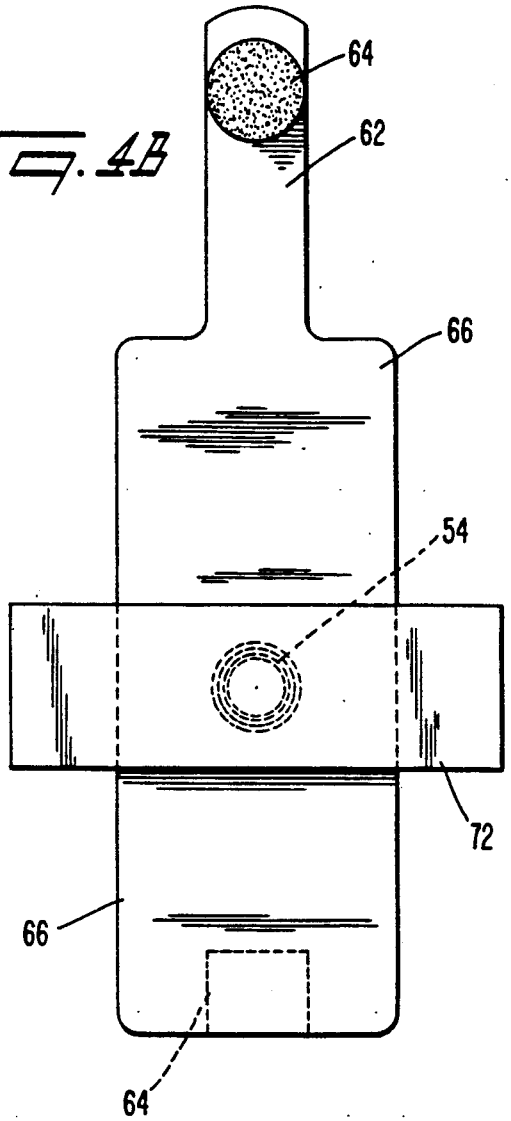
FIG. 4B illustrates a top view of the bottle holder.
Figure 4C:
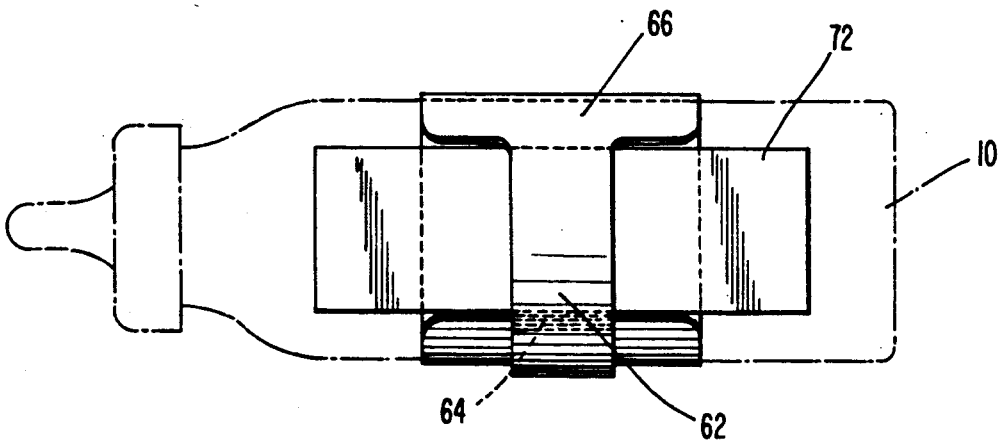
FIG. 4C illustrates a closed view of the bottle holder.

FIG. 4B shows the ridged member, 72 opened up exposing the flexible member 66 and buckle 64. FIG. 4C depicts a closed view of the ridged member 72 and flexible member 66 with buckle 64 securing the flexible member 66. FIG. 4D shows an additional view of the ridged member 72, flexible member 66 and belt 62. A bottom view is shown in FIG. 4E of the flexible member 66 with means, embodied as a screw hole 74, for attaching the flexible member 66 to the first flexible rod 54.

Figure 5:
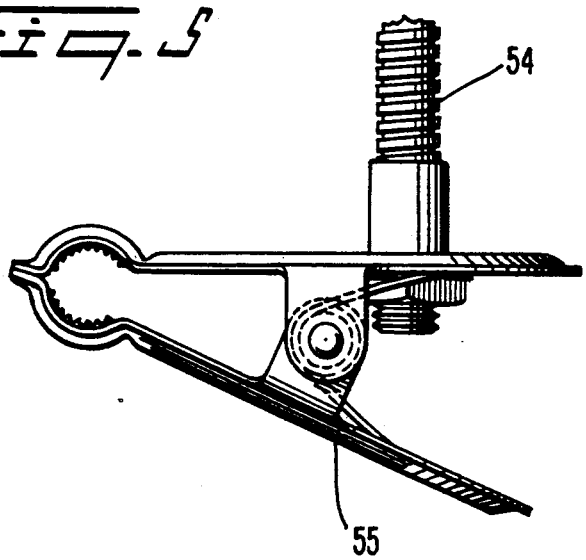
FIG. 5 illustrates a flexible rod with a clamp.
Figure 6:
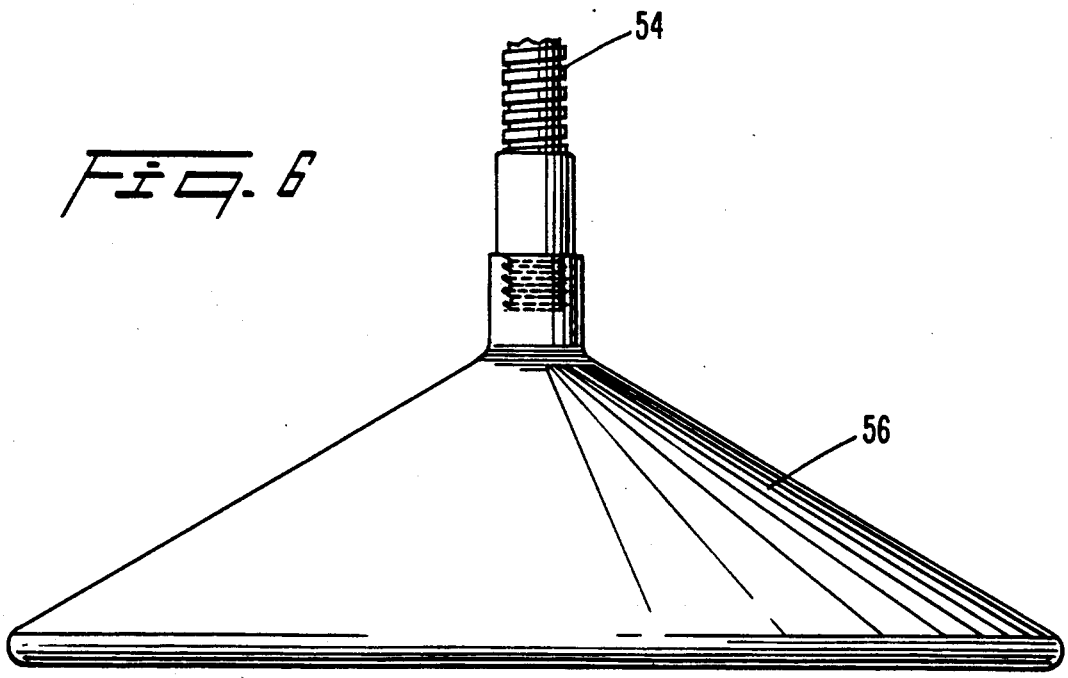
FIG. 6 illustrates a flexible rod with a stand member.

FIG. 5 illustratively shows a first flexible rod 54 connecting to a clamp member 55. The clamp member 55 attaches to the second end of the first flexible rod 54. FIG. 6 shows the first flexible rod 54 attaching to a stand member 56. As previously disclosed, goose neck type tubing can be used for flexing the first flexible rod or the second flexible rod in any style. The baby-bottle support may be used with a first flexible rod 54 having only a stand member or having only a clamp member. Such embodiments are shown in FIGS. 2A, 2B, and 2C. Alternately, the present invention may additionally have the first flexible rod 54 connected to the second flexible rod 52 as shown in FIG. 3B. In the latter embodiment, increased stability is provided from the clamp member 55 attaching to a seat, and the stand member 56 being placed on a surface.

In use, a person would either clamp or stand the device near a baby, and wrap the flexible member around the baby bottle and secure the baby bottle with the buckle. The resistance of the movement of the first flexible rod, even if used alone, would be greater than any substantial force applied by the infant to the bottle holder. Accordingly, an infant would not be able to move the device to any degree based on the resistance provided therein.

Embodied with a clamp member, the device may be used with a seat, stroller or other type of apparatus for holding the infant. Without the clamp, the device may be used with the stand member 56 on any surface, readily allowing the infant access to the bottle.

The bottle holder can be of any type which can grip and securely holds a bottle. As shown, however, the bottle holder would preferably use the flexible member along with the belt and buckle as shown.

In use, as the baby being fed moves his mouth, the proximal end of the bottle is free to move, and enables the orientation of the first flexible member while retaining the bottle in the same general spacial area. If the baby should move so that he loses the bottle, the device with the bottle holder gently applies pressure to the check of the baby, inducing the baby to recommence feeding.

It will be apparent to those skilled in the art that various modifications can be made to the baby-bottle support of the instant invention without departing from the scope of spirit of the invention and it is intended that the present invention cover modifications and variations of the baby-bottle support provided they come within the scope of the appended claims and their equivalents.

I claim:

1. A device for supporting an infant's feeding bottle selected from a plurality of feeding bottles having a range of different diameters, while feeding an infant in a seat placed on a surface, comprising:

a bottle holder including a rigid member for stabilizing said feeding bottle, and including a flexible member attached to said rigid member for wrapping around said feeding bottle, said flexible member including means for securing said feeding bottle to said rigid member of said bottle holder;

a first flexible rod having a first end attached to said bottle holder, and having a second end;

a second flexible rod having a first end pivotally attached to said first flexible rod, and having a second end;

a clamp member attached to the second end of said second flexible rod for clamping to said seat;

a stand member attached to said second end of said first flexible rod for stabilizing said device on said surface; and wherein the combination of said first flexible rod and said second flexible rod provides a substantial resistance to any movement.

2. A device for supporting an infant's feeding bottle selected from a plurality of feeding bottles having a range of different diameters, while feeding an infant in a seat placed on a surface, comprising:

a bottle holder including a flexible member for wrapping around said feeding bottle, said flexible member including means for securing said feeding bottle to said bottle holder;

a first flexible rod having a first end attached to said bottle holder, and having a second end;

a second flexible rod having a first end attached to said first flexible rod, and having a second end;

means attached to the second end of said second flexible rod for attaching to said seat; and stand means attached to said second end of said first flexible rod for stabilizing said device on said surface.

3. The device for supporting the infant's feeding bottle as set forth in claim 2 wherein the combination of said first flexible rod and said second flexible rod provides a substantial resistance to a movement of said bottle holder due to said infant.

* * * * *